US010163281B2

(12) United States Patent
Le et al.

(10) Patent No.: US 10,163,281 B2
(45) Date of Patent: Dec. 25, 2018

(54) ADAPTIVE VEHICLE MONITORING SYSTEM

(71) Applicant: INNOVA ELECTRONICS CORPORATION, Irvine, CA (US)

(72) Inventors: Tan Minh Le, Phu My District (VN); Hung Phan, Anaheim, CA (US); Si Tan Truong, Xuan Loc (VN)

(73) Assignee: INNOVA ELECTRONICS CORPORATION, Irvine, CA (US)

( * ) Notice: Subject to any disclaimer, the term of this patent is extended or adjusted under 35 U.S.C. 154(b) by 35 days.

(21) Appl. No.: 15/404,976

(22) Filed: Jan. 12, 2017

(65) Prior Publication Data

US 2018/0197358 A1 Jul. 12, 2018

(51) Int. Cl.
*G07C 5/08* (2006.01)

(52) U.S. Cl.
CPC ..... *G07C 5/0858* (2013.01)

(58) Field of Classification Search
CPC ..... G07C 5/0858; G07C 2205/02
USPC ..... 701/33.2, 33.3, 34.2
See application file for complete search history.

(56) References Cited

U.S. PATENT DOCUMENTS

| | | | |
|---|---|---|---|
| 5,347,211 | A | 9/1994 | Jakubowski |
| D377,622 | S | 1/1997 | Chen |
| 5,635,841 | A | 6/1997 | Taylor |
| 5,758,300 | A | 5/1998 | Abe |
| 5,767,681 | A | 6/1998 | Huang |
| 5,809,437 | A | 9/1998 | Breed |
| 5,859,628 | A | 1/1999 | Ross et al. |
| 5,884,202 | A | 3/1999 | Arjomand |
| 6,000,413 | A | 12/1999 | Chen |
| 6,055,468 | A | 4/2000 | Kaman et al. |
| 6,094,609 | A | 7/2000 | Arjomand |
| 6,169,943 | B1 | 1/2001 | Simon et al. |
| 6,225,898 | B1 | 5/2001 | Kamiya et al. |
| 6,263,268 | B1 | 7/2001 | Nathanson |
| 6,389,337 | B1 | 5/2002 | Kolls |
| 6,438,471 | B1 | 8/2002 | Katagishi et al. |
| 6,499,385 | B2 | 12/2002 | Protti |
| 6,535,112 | B1 | 3/2003 | Rothshink |
| 6,587,768 | B2 | 7/2003 | Chene et al. |
| 6,611,740 | B2 | 8/2003 | Lowrey et al. |

(Continued)

FOREIGN PATENT DOCUMENTS

| | | |
|---|---|---|
| WO | WO 0186576 | 11/2001 |

*Primary Examiner* — Nadeem Odeh
(74) *Attorney, Agent, or Firm* — Stetina Brunda Garred and Brucker

(57) ABSTRACT

A system and method are provided for adaptively accessing information in a vehicle under test, in a manner to avoid malfunctions associated with accessing the information. A data acquisition device is provided for accessing and retrieving diagnostic data from the vehicle. A memory unit is provided including listing of malfunctioning vehicles, as well as information associated with each of vehicle. At least one service mode request is communicated to the vehicle to identify characteristic information and characteristic features of the vehicle, which information is compared to stored vehicle characteristic information, to determine if the vehicle conforms to any of the listed vehicles, subject to malfunction. If not, additional service requests are communicated to the vehicle. If the vehicle conforms to one or more of the listed vehicles additional service request(s) are modified to remove service requests, or portions thereof, that are associated with the malfunction.

20 Claims, 5 Drawing Sheets

(56) References Cited

U.S. PATENT DOCUMENTS 6,650,318 B1 11/2003 Amon
6,718,425 B1 4/2004 Pajakowski et al.
6,732,031 B1 5/2004 Lightner et al.
6,807,469 B2 10/2004 Funkhouser et al.
6,836,708 B2 12/2004 Tripathi
6,847,916 B1 1/2005 Ying
6,868,369 B2 3/2005 Huang
6,925,368 B2 8/2005 Funkhouser et al.
6,940,270 B2 9/2005 Chen
D510,287 S 10/2005 Chen
6,957,133 B1 10/2005 Hunt et al.
6,968,733 B2 11/2005 Andreasen
7,030,742 B2 4/2006 Treadway
7,085,680 B2 8/2006 Huang
7,116,216 B2 10/2006 Andreasen
D334,560 S 4/2007 Wilson
7,209,813 B2 4/2007 Namaky
RE39,619 E 5/2007 Andreasen
D545,223 S 6/2007 Chen
D559,137 S 1/2008 Protti
D560,129 S 1/2008 Rich
D560,527 S 1/2008 Rich
D588,621 S 1/2008 Rich
7,325,775 B2 2/2008 Chen
D563,249 S 3/2008 Chen
7,363,149 B2 4/2008 Klausner et al.
D569,280 S 5/2008 Chen
7,376,497 B2 5/2008 Chen
D571,241 S 6/2008 Andreasen
7,437,227 B2 10/2008 Andreasen
D581,822 S 12/2008 Madison
7,464,000 B2 12/2008 Huang
D590,387 S 4/2009 Chen
7,520,668 B2 4/2009 Chen
RE40,798 E 6/2009 Chen
RE40,799 E 6/2009 Chen
7,603,293 B2 10/2009 Chen
7,620,484 B1 11/2009 Chen
D610,586 S 2/2010 Chen
7,734,390 B2 6/2010 Chen
7,778,750 B2 8/2010 Knight et al.
D624,446 S 9/2010 Chen
D624,838 S 10/2010 Chen
D625,209 S 10/2010 Chen
D625,210 S 10/2010 Chen
D625,634 S 10/2010 Chen
7,904,219 B1 3/2011 Lowrey et al.
7,974,750 B2 7/2011 Namaky
8,019,503 B2 9/2011 Andreasen
8,024,083 B2 9/2011 Chen
D646,188 S 10/2011 Chen
D646,599 S 10/2011 Chen
8,032,419 B2 10/2011 Chen
8,068,951 B2 11/2011 Chen et al.
8,301,329 B2 10/2012 Andreasen
8,306,687 B2 11/2012 Chen
8,370,018 B2 2/2013 Andreasen et al.
8,509,986 B1 8/2013 Chen
8,630,765 B2 1/2014 Chen
8,825,270 B2 9/2014 Chen
8,825,271 B2 9/2014 Chen
8,831,814 B2 9/2014 Chen
8,855,621 B2 10/2014 Chen
8,862,117 B2 10/2014 Chen
8,880,274 B2 11/2014 Chen
8,909,416 B2 12/2014 Chen et al.
9,002,554 B2 4/2015 Chen
9,014,908 B2 4/2015 Chen
9,026,400 B2 5/2015 Chen et al.
9,117,319 B2 8/2015 Chen et al.
9,123,051 B2 9/2015 Chen
9,141,503 B1 9/2015 Chen
9,142,066 B2 9/2015 Chen et al.
9,177,428 B2 11/2015 Nguyen et al.
9,213,447 B2 12/2015 Chen
9,324,194 B2 4/2016 Pham
9,342,934 B2 5/2016 Chen
9,384,599 B2 7/2016 Chen et al.
9,494,125 B2 11/2016 Pham et al.
2003/0171111 A1 9/2003 Clark
2004/0110472 A1 6/2004 Witkowski
2014/0046800 A1 2/2014 Chen
2016/0027223 A1 1/2016 Madison et al.
2016/0055684 A1 2/2016 Chen
2016/0104328 A1 4/2016 Chen et al.
2016/0188195 A1 6/2016 Chen

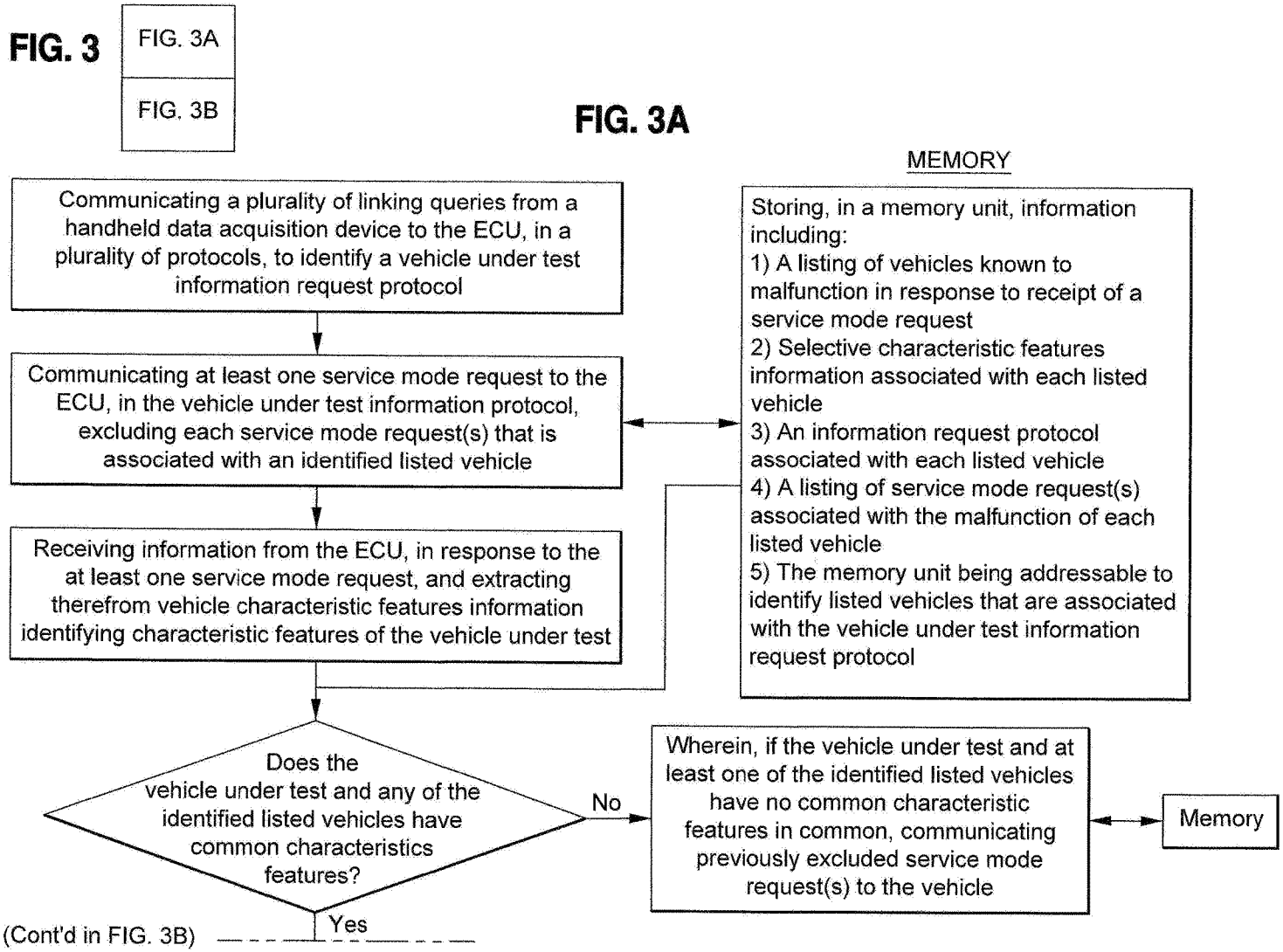
FIG. 3
FIG. 3A
FIG. 3B
FIG. 3A
MEMORY
Communicating a plurality of linking queries from a handheld data acquisition device to the ECU, in a plurality of protocols, to identify a vehicle under test information request protocol
Communicating at least one service mode request to the ECU, in the vehicle under test information protocol, excluding each service mode request(s) that is associated with an identified listed vehicle
Storing, in a memory unit, information including:
1) A listing of vehicles known to malfunction in response to receipt of a service mode request
2) Selective characteristic features information associated with each listed vehicle
3) An information request protocol associated with each listed vehicle
4) A listing of service mode request(s) associated with the malfunction of each listed vehicle
5) The memory unit being addressable to identify listed vehicles that are associated with the vehicle under test information request protocol
Receiving information from the ECU, in response to the at least one service mode request, and extracting therefrom vehicle characteristic features information identifying characteristic features of the vehicle under test
Does the vehicle under test and any of the identified listed vehicles have common characteristics features?
No
Yes
Wherein, if the vehicle under test and at least one of the identified listed vehicles have no common characteristic features in common, communicating previously excluded service mode request(s) to the vehicle
Memory
(Cont'd in FIG. 3B)

ADAPTIVE VEHICLE MONITORING SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to vehicle diagnostic systems and methods, and, more particularly, to devices and methods for adaptively accessing vehicle diagnostic information in a manner to avoid engine specific anomalies.

Since the 1980's, major automobile manufacturers have installed electronic control units (ECU) in vehicles being produced. ECU's generally function to monitor various vehicle conditions and recognize malfunctions or trouble conditions, which may be recorded in the vehicle ECU. Technicians servicing the vehicles have used scan tools, or other equipment that enables them to access the ECU to download vehicle diagnostic trouble codes (DTC's) that would identify the malfunctions or trouble conditions detected by and stored in the ECU.

Since the 1980's, the sophistication of the vehicle ECU's, scan tools and other equipment used to access information in the ECU's has become more sophisticated. The vehicle information accessible by or through the ECU has expanded to include a variety of different types of information, e.g., live information and/or stored information from various vehicle components. Moreover, the processing capability of the ECU, as well as the scan tool, have expanded to allow the technician to more specifically identify vehicle defects by accessing and comparing information received from the vehicle, using sophisticated databases that may be stored or distributed within the ECU, the scan tool, and remote locations, e.g., websites accessible by the scan tool itself, or in association with a digital computing device, such as a computer or cellphone.

In order to facilitate the use of common equipment and communication techniques for accessing information on different vehicles, vehicle original equipment manufacturers (OEMs) utilize one of approximately five different signal protocols for communicating information and commands to or from the ECU. Contemporary scan tools and similar devices commonly connect to the ECU through a vehicle diagnostic port, and operate to poll the ECU, by sequencing through each of the different protocols until the ECU response to one of the protocols. The scan tool will then communicate with the ECU in the identified protocol to request information from the ECU and other vehicle systems.

While the above described ECU interface system generally works well and is a reliable way to access information from the vehicle ECU, anomalies occasionally arise in relation to particular engines. For example, it has been found that certain Ford® vehicles equipped with 7.3 L diesel engines will stall if certain diagnostic information is requested from the vehicle ECU while the vehicle is running, e.g. engines and related electronic controls for the engine are understood to have been produced by Navistar International (engine code T444D) during 1994-2003. This can create a safety condition, particular as that vehicle may be used to tow excessive loads. Since the functionality of hydraulic power assisted braking (Hydro Boost) systems and steering systems are generally dependent upon the engine being operational, a sudden engine stall can be problematical. While OEMs generally take steps to ensure that power and fluid remains available in the event of such a stall, the stored power and fluid under pressure may be very limited, e.g., to power assisted brake applications, which may be insufficient to avoid a dangerous and potentially fatal condition.

The present invention is directed to an apparatus and technique for modifying the manner in which a scan tool, or other diagnostic device, communicates with a vehicle ECU to determine if the vehicle under test is subject to causing an operational anomaly in response to a standard information requests to the vehicle ECU. If so, the present invention functions to modify the information requests in such a manner to be able to avoid the anomaly, i.e., by omitting or modifying the information request that has been found to trigger the anomaly.

BRIEF SUMMARY

A system and method are provided for adaptively accessing information in a vehicle under test, in a manner to avoid malfunctions associated with accessing the information. A data acquisition device is provided for accessing and retrieving diagnostic data from the vehicle. A memory unit is provided including listing of malfunctioning vehicles, as well as information associated with each of the listed vehicles. At least one service mode request is communicated from the data acquisition device to the vehicle to identify characteristic features of the vehicle, which information is compared to stored vehicle characteristic information, to determine if the vehicle conforms to any of the listed vehicles, subject to malfunction. If not, additional service requests are communicated to the vehicle.

More specifically, the system comprises a data acquisition device including a first datalink communicable with the vehicle ECU, for accessing and retrieving diagnostic data from the vehicle under test. The data acquisition device may further include a processor unit, in communication with the first datalink, the processor unit including a data linking module operative to generate linking queries to the ECU, in a plurality of protocols, to identify the information request protocol used by the vehicle under test.

A memory unit is provided in communication with the processor. The memory unit may include: 1) a listing of vehicles known to malfunction in response to receipt of a service mode request; 2) a listing of selective characteristic features information associated with each listed vehicle; 3) an information request protocol associated with each listed vehicle; and 4) a listing of the specific service mode request(s) associated with a malfunction of each listed vehicle. The memory unit is addressable by the processor unit to identify listed vehicles (i.e., vehicles subject to malfunction) that are associated with the vehicle under test information request protocol.

The data acquisition device may further include data retrieval mode operative to selectively communicate at least one service request to the ECU, in the vehicle under test information request protocol, excluding each service mode request(s), or portion thereof, that is associated with an identified vehicle.

The data acquisition device may further include a data extraction module operative to receive information from the ECU, in response to the at least one service request, and extract therefrom vehicle characteristic features information, identifying characteristic features of the vehicle under test.

The data acquisition device may further include a comparison module operative to compare the extracted characteristic features information to the selective characteristic features information associated with each of the identified listed vehicles, to determine if the vehicle under test and any of the identified listed vehicles have common characteristic features. If the vehicle under test has no characteristic features in common with any of the identified listed vehicles, the data retrieval unit may be further operative to communicate the previously excluded service mode request(s) to the vehicle under test.

If the vehicle under test and at least one of the identified vehicles have one or more common characteristic features, the data retrieval unit may be operative to communicate additional service mode request to the vehicle under test, excluding any service mode request(s), or portions thereof, associated with at least one of the listed vehicles.

Where the vehicle under test and a plurality of the identified listed vehicles have one or more common characteristic features, the comparison module may be further operative to determine which of the plurality of identified listed vehicles is the closest to the vehicle under test, e.g., which of the identified listed vehicles has the greatest number of characteristic features in common with the vehicle under test. The data retrieval unit is further operative to communicate additional service mode request to the vehicle under test, excluding any service mode request(s), or portion thereof, that is associated with the identified listed vehicle having the greatest number of characteristic features in common with the vehicle under test.

In one embodiment, the first datalink is directly connectable to a data port of a vehicle under test. In another embodiment the first datalink may be wirelessly communicable with the ECU of the vehicle under test.

In one embodiment, the handheld data acquisition device may be implemented as a scan tool. In other embodiments the data acquisition device may be implemented as a smartphone, computer tablet, dongle, or other programmable device that is wirelessly communicable with the ECU.

In one embodiment the memory unit may be disposed within the handheld data acquisition device. In another embodiment, the memory unit may be disposed remote from the handheld data acquisition device, and accessible by the data acquisition device via a second datalink connectable to a global computer network, for transferring information between the data acquisition device and the remote memory unit.

In one embodiment the present invention is implemented in a manner specific to obtaining information from an ECU of a diesel engine vehicle, wherein the diesel engine vehicle is associated with a malfunction arising in response to receipt of a particular service mode request and/or service mode request portion, while the diesel engine is running. Where the vehicle under test is a diesel engine vehicle, and the engine is currently running, service mode requests, or portions thereof, associated with the malfunction in diesel engine vehicles are not communicated to the vehicle under test.

BRIEF DESCRIPTION OF THE DRAWINGS

These and other features and advantages of the various embodiments disclosed herein will be better understood with respect to the following description and drawings, in which like numbers refer to like parts throughout, and in which:

FIGS. 3, 3A, and 3B are flowcharts illustrating an exemplary, process implemented by the present invention.

DETAILED DESCRIPTION

The following description is given by way of example, and not limitation. Given the following disclosure, one skilled in the art could devise variations that are within the scope and spirit of the invention disclosed herein, including various alternate ways of retrieving, processing and operating on vehicle diagnostic information, in accordance with the present invention. Further, the various modules and features of the embodiments disclosed herein can be used alone, or in varying combinations with each other and are not intended to be limited to the specific combination described herein. Thus, the scope of the claims is not to be limited by the illustrated embodiments.

Figure 1:
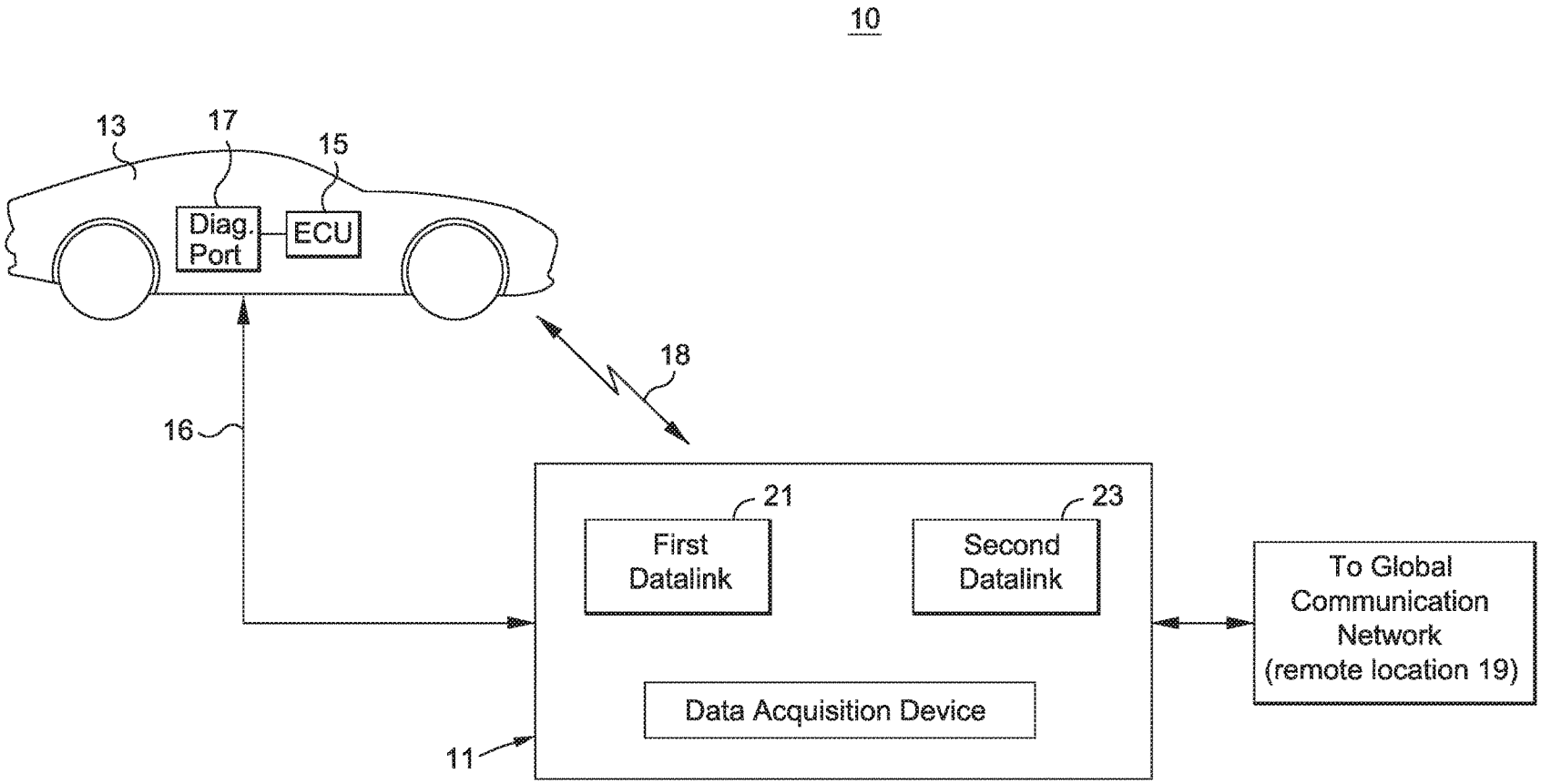
FIG. 1 illustrates an exemplary operating environment of the present invention.

FIG. 1 illustrates an operating environment in which the present invention finds application. In accordance with the present invention the adaptive vehicle monitoring system 10 uses a data acquisition device 11 to communicate with vehicle 13, to obtain diagnostic information concerning the status and operating condition of vehicle systems. The data acquisition device 11 includes a first datalink 21 which may communicate with the vehicle's ECU 15 via hard wired link 16 to the vehicle diagnostic port 17. Alternatively, the data acquisition device may communicate with the vehicle electronic control unit (ECU) 15 via wireless datalink 18. Information received from the vehicle 13 is processed within the data acquisition device, as described in more detail below.

The data acquisition device 11 may further include a second datalink 23, that is communicable with the remote location 19 via a global computer network or by another communications link.

The data acquisition device 11 may be implemented as a scan tool arranged in programs to implement the present invention, as described more fully below. Alternatively, the data acquisition device 11 may be implemented as a smartphone, tablet computer, dongle, or other computing device operative to implement the functions of the present invention, as described more fully below.

In general, the data acquisition device functions in a manner similar to a conventional scan tool, in relation to the basic functionality of the present invention. However, the present invention departs from conventional scan tool operations in the manner in which the data acquisition device selectively retrieves and processes data in the manner to avoid vehicle malfunctions that may arise during implementation of the conventional vehicle monitoring process in certain vehicles. In essence, the present invention modifies the conventional vehicle diagnostic system and methodology to adapt to anomalous operating conditions in certain vehicles. As described in more detail below, the present invention retrieves certain limited data from the vehicle ECU, to allow the data acquisition device 11 to determine the operating characteristics of the vehicle 13, and evaluate whether or not the vehicle is subject to such anomalous conditions. If so, the present invention proceeds with the vehicle diagnostic process in a manner that avoids triggering malfunctions known to be present in the vehicle.

Figure 2:
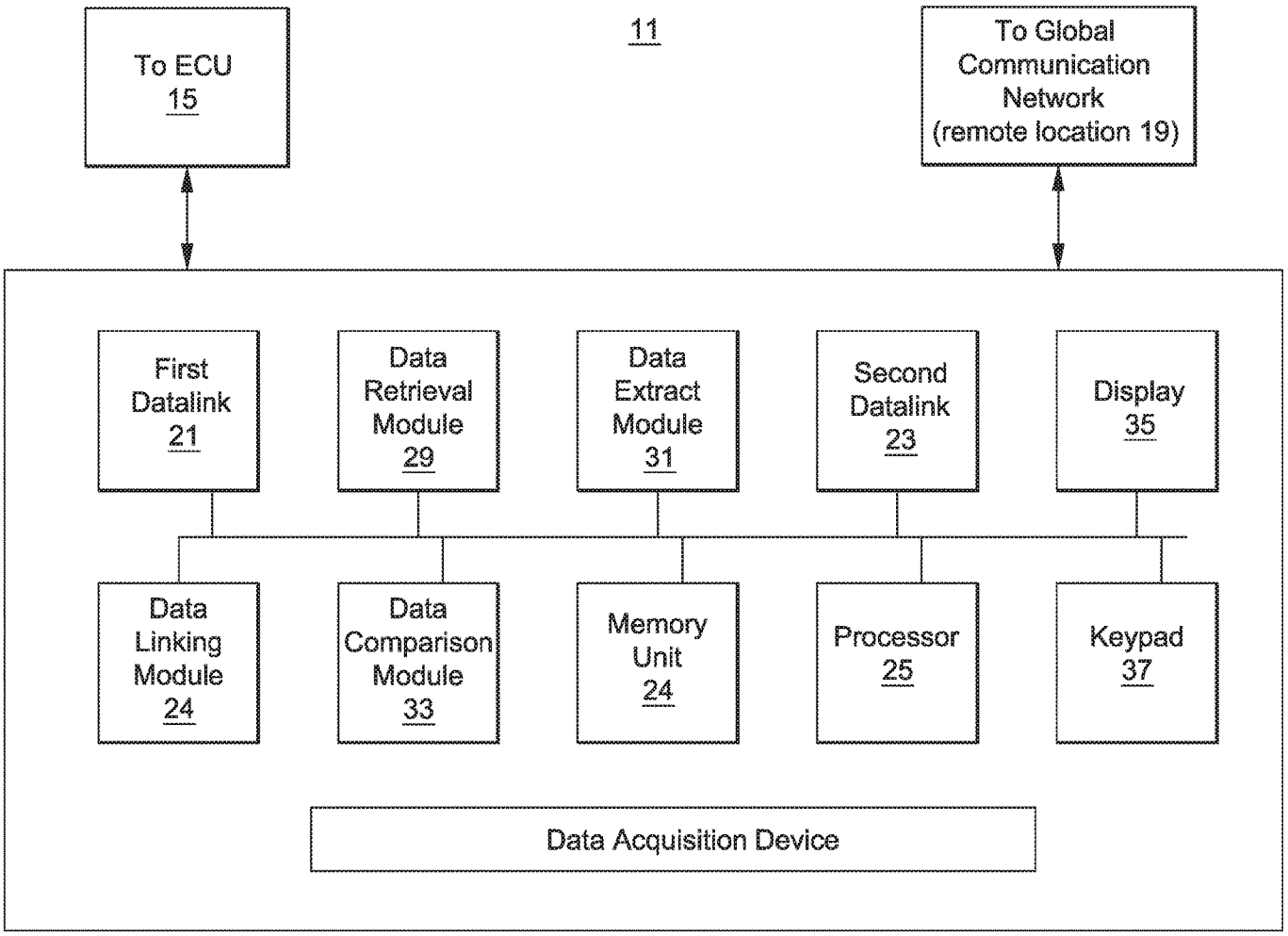
FIG. 2 is a block diagram illustrating the functional components of the data acquisition device in accordance with the present invention.
Figure 3B:
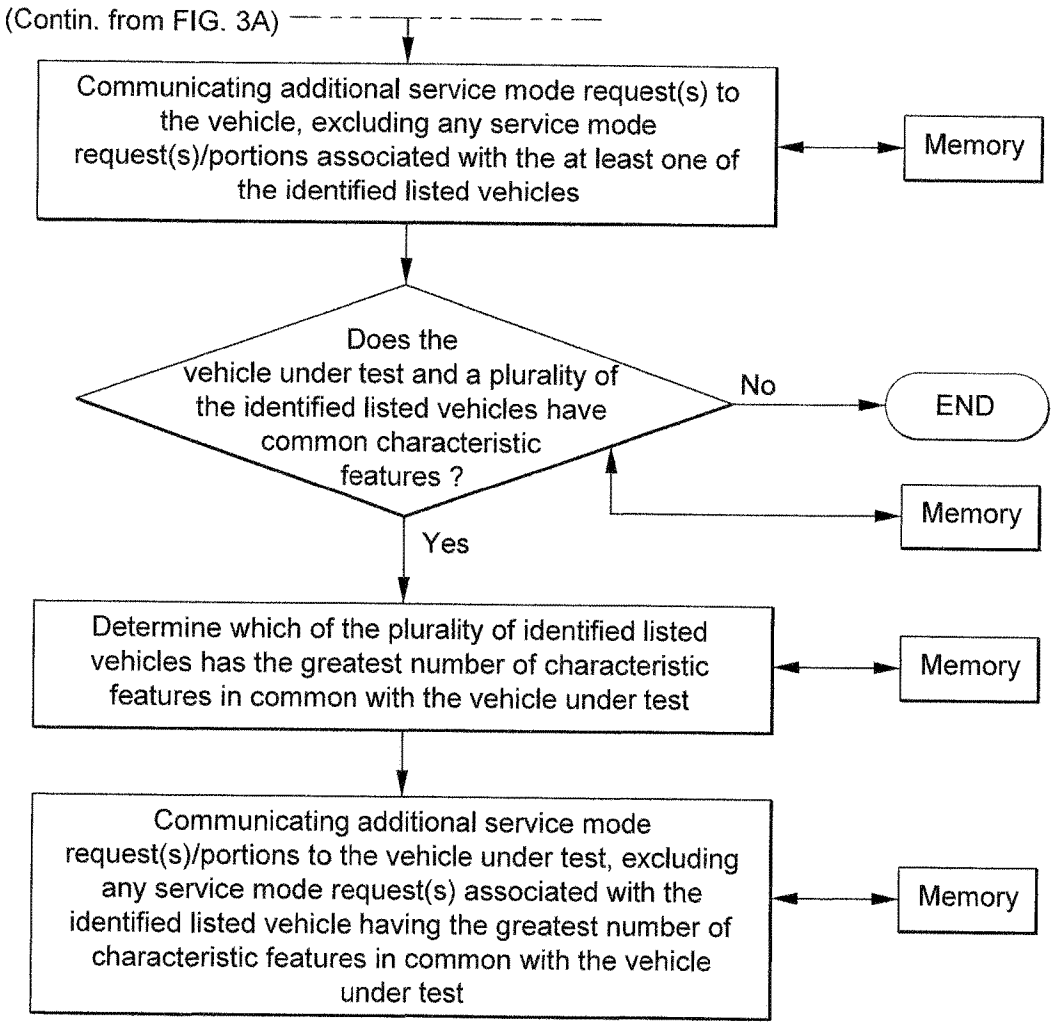

FIG. 2 is a block diagram illustrating the primary functional modules of the exemplary data acquisition device 11. The operation of the data acquisition device 11 will be described, in combination with the flowchart set forth at FIG. 3.

It is to be understood that numerous modules of the data acquisition device, including but not limited to the data retrieval module 29, the data extraction module 31, and the data comparison module 33 may be implemented in software programming, operated on by microprocessor 25. However, the modules are illustrated separately in order to more clearly differentiate the functionality of the modules.

Referring to FIG. 2, the data acquisition device 11 includes a first datalink 21 communicable with the ECU 15 of vehicle 13, for accessing and retrieving diagnostic data from the vehicle 13. A processor unit 25 is in communication with the first datalink and includes data linking module 24, operative to generate linking queries for communication to the ECU 15 in a plurality of protocols, to identify the information request protocol of the vehicle 13.

Memory unit 27 is also in communication with the processor 25. The memory unit includes information stored therein including: 1) a listing of vehicles known to malfunction in response to receipt of a service mode request for diagnostic information from the vehicle; 2) a listing of selective characteristic features information associated with each listed vehicle; 3) an information request protocol associated with each listed vehicle; and 4) a listing of specific service mode request(s) associated with a malfunction of each listed vehicle. The memory unit 27 is addressable by processor 25 to identify listed vehicles that are associated with the vehicle under test information request protocol.

The data acquisition device may further include a data retrieval module 29, operative to selectively communicate at least one service mode request to the ECU, in the vehicle under test information request protocol, excluding each service mode request(s) that is associated with an identified listed vehicle.

The data acquisition device 11 may further include a data extraction module 31 operative to receive information from the ECU, in response to the at least one service mode request, and to extract therefrom vehicle characteristic features information, identifying characteristic features of the vehicle under test.

The data acquisition module may further include a data comparison module 33, operative to compare the extracted characteristic features information to the selective characteristic features information associated with each of the identified listed vehicles, to determine if the vehicle under test and any of the identified listed vehicles have common characteristic features. Where the vehicle under test and the identified listed vehicles have no common characteristic features, the data retrieval unit 29 is further operative to communicate any previously excluded service mode requests and the request (s) to the vehicle under test. As shown in FIG. 2, the data acquisition device 11 may also include a display 35 and keypad 37.

Where the vehicle under test and at least one of the identified listed vehicles have one or more common characteristic features, the data retrieval unit is further operative to communicate additional service mode request(s) to the vehicle under test, excluding any service mode request, or portion thereof, that is associated with at least one of the identified listed vehicles.

Where the vehicle under test and a plurality of the identified listed vehicles have one or more common characteristic features, the data comparison module 33 is further operative to determine which of the plurality of identified listed vehicles most closely conforms to the vehicle under test, e.g., which of the identified vehicles has the greatest number of characteristic features in common with the vehicle under test. The data retrieval module is then further operative to communicate additional service mode requests to the vehicle under test, excluding service mode requests associated with the closest identified listed vehicle, e.g., the identified listed vehicle having the greatest number of characteristic features in common with the vehicle under test.

As noted above, the memory unit 27 may be disposed within the data acquisition device 11, or located at remote locations 19, which may be addressable via a global communication network.

As noted above, the present invention may be implemented in a broadly adaptive manner, as described above, or may be implemented in a more specifically adapted manner, to address specific malfunctions, such as malfunctions associated with accessing information from a diesel engine, while the engine is running. As noted above, potential safety issues may arise where certain diesel engine vehicles receive a service mode nine request, which requests a vehicle identification number (VIN) and other information from the powertrain control module (PCM) while the engine is running. This may cause the functioning engine to stall. The 7.3 L engine was available on three-quarter ton and larger trucks and vans during model year 1994 to 2003. As explained further below, the present invention modifies the sequence and/or substances of service mode requests to the ECU where if the information received from the ECU indicates that the vehicle is a diesel engine that is running. The scan tool or similar equipment will omit a service call for service mode nine from the sequence of service modes that service mode calls communicated to the ECU. Accordingly, as described above, the data acquisition device is adaptive to be able to recognize vehicles subject to anomalous conditions, arising thereof, as a result of service mode calls to the ECU, and to adapt the service mode calls, and the sequence to avoid triggering such anomalies.

Figure 4:
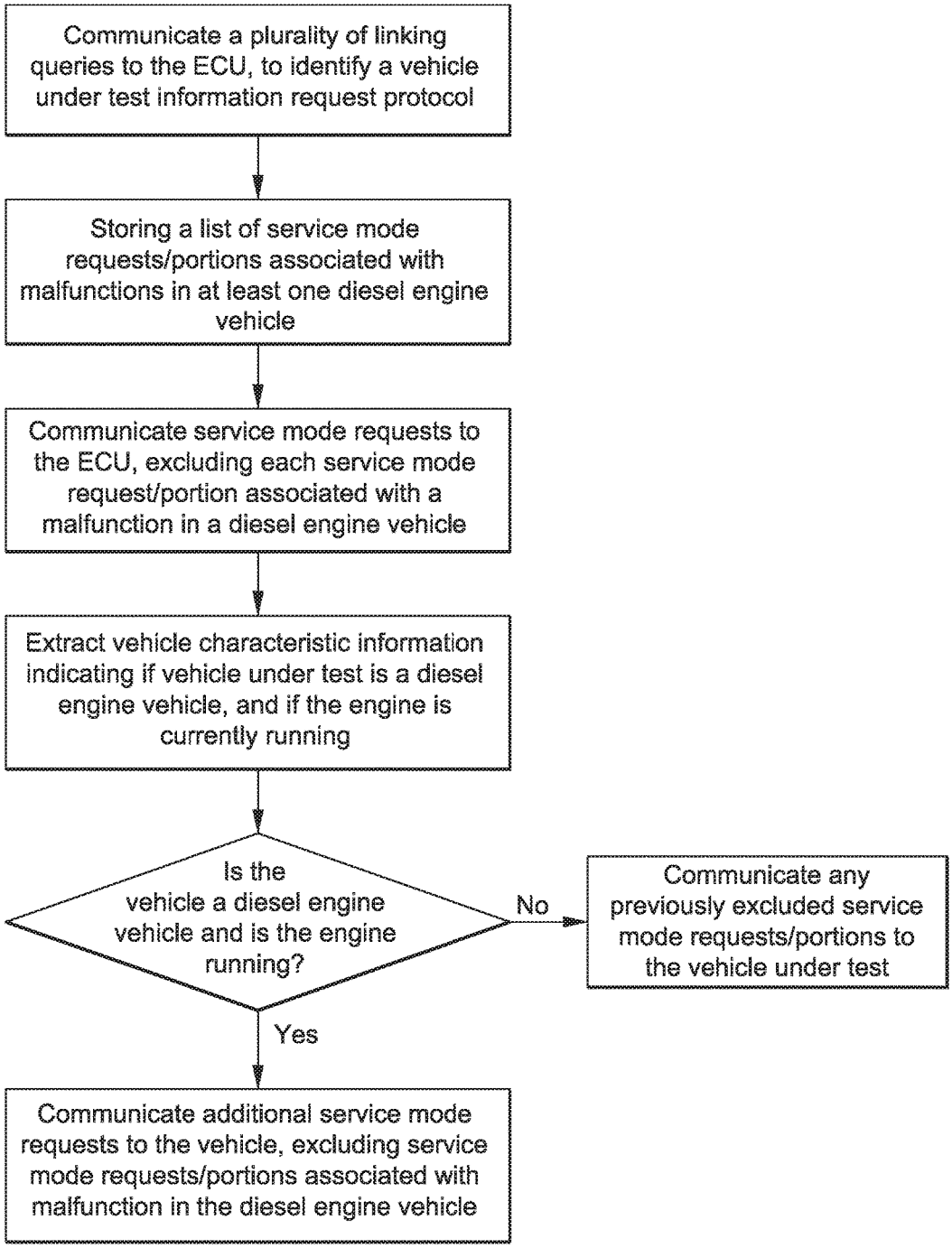
FIG. 4 is a flowchart illustrating an alternate exemplary process implemented by the present invention.

FIG. 4 illustrates a process that may be implemented to access information in the ECU of a diesel engine vehicle, to avoid such a malfunction. The process may similarly be implemented on a handheld data acquisition device, such as a scan tool, smartphone, tablet computer or other computing device. The process again begins by communicating a plurality of linking queries to the vehicle ECU 15, in a plurality of protocols, to identify the vehicle under test information request protocol.

Information is stored in a memory unit listing service mode requests, and/or portions thereof associated with malfunction in at least one diesel engine vehicle.

At least one service mode request is communicated to the ECU, in the vehicle under test information request protocol, excluding each service mode request, or portion thereof, associated with a malfunction in the diesel engine vehicle. In response to the at least one service mode request, information is received from the ECU, and vehicle characteristic information is extracted therefrom, indicating if the vehicle under test is a diesel engine vehicle, and if the engine is currently running. If the vehicle is a diesel engine vehicle, and is currently running, additional service mode requests, or portions thereof may be communicated to the vehicle ECU, excluding any service mode request, or portion thereof, that is associated with a malfunction in the diesel engine vehicle.

What is claimed is:

1. A vehicle monitoring system for adaptively accessing information in an electronic control unit (ECU) of a vehicle under test, in a manner to avoid vehicle malfunctions associated with accessing the information, the system comprising:

a) a handholdable data acquisition device communicable with the ECU of the vehicle under test for accessing and retrieving diagnostic data from the vehicle under test and operative to generate linking queries to the ECU in a plurality of protocols, to identify a vehicle under test information request protocol;

b) a memory unit having information stored therein including:

1) a listing of vehicles known to malfunction in response to receipt of a service mode request;

2) a listing of selective characteristic features information associated with each listed vehicle;

3) an information request protocol associated with each listed vehicle; and 4) a listing of one or more specific service mode requests associated with a malfunction of each listed vehicle;

the memory unit being addressable by a processor unit in the data acquisition device to identify listed vehicles that are associated with the vehicle under test information request protocol;

c) the data acquisition device further being operative to selectively communicate at least one service mode request to the ECU, in the vehicle under test information request protocol, excluding each service mode request that is associated with an identified listed vehicle;

d) the data acquisition device further being operative to receive information from the ECU, in response to the at least one service mode request being communicated to the ECU, and extract therefrom vehicle characteristic features information, identifying characteristic features of the vehicle under test; and e) the data acquisition device further being operative to compare the extracted characteristic features information to the selective characteristic features information associated with each of the identified listed vehicles, to determine if the vehicle under test and any of the identified listed vehicles have common characteristics features;

f) wherein, when the vehicle under test has no characteristics features in common with any of the identified listed vehicles, the data acquisition device is further operative to communicate each previously excluded service mode request to the vehicle under test.

2. The vehicle monitoring system as recited in claim 1 wherein, when the vehicle under test and at least one of the identified listed vehicles have one or more in common characteristic features, the data acquisition device is further operative to communicate at least one additional service mode request to the vehicle under test, excluding any service mode request associated with the at least one of the identified listed vehicles.

3. The vehicle monitoring system as recited in claim 2 wherein, when the vehicle under test and a plurality of the identified listed vehicles have one or more in common characteristic features, the data acquisition device is further operative to determine which of the plurality of identified listed vehicles has the greatest number of characteristic features in common with the vehicle under test, and to communicate additional service mode requests to the vehicle under test, excluding service mode requests associated with the identified listed vehicle having the greatest number of characteristics features in common with the vehicle under test.

4. The vehicle monitoring system as recited in claim 1 wherein the processor unit is communicable with the memory unit to identify any listed vehicle subject to malfunction in response to service mode requests under the identified protocol, and characteristics features associated with any identified listed vehicle.

5. The vehicle monitoring system as recited in claim 1 wherein the data acquisition device is connectable to a data port of the vehicle under test.

6. The vehicle monitoring system as recited in claim 1 wherein the data acquisition device is wirelessly communicable with the ECU.

7. The vehicle monitoring system as recited in claim 1 wherein the memory unit is disposed within the data acquisition device.

8. The vehicle monitoring system as recited in claim 1 wherein the memory unit is remotely located from the data acquisition device.

9. The vehicle monitoring system as recited in claim 8 wherein the data acquisition device is connectable to a global computer network for transferring information to a location remote from the data acquisition device.

10. A method of accessing information in an electronic control unit (ECU) of a vehicle under test, in a manner to avoid vehicle malfunctions associated with accessing the information in the ECU, the method comprising:

a) communicating a plurality of linking queries from a handheld data acquisition device to the ECU, in a plurality of protocols, to identify a vehicle under test information request protocol;

b) storing, in a memory unit, information including:

1) a listing of vehicles known to malfunction in response to receipt of a service mode request;

2) selective characteristic features information associated with each listed vehicle;

3) an information request protocol associated with each listed vehicle; and 4) a listing of at least one service mode request associated with the malfunction of each listed vehicle;

the memory unit being addressable to identify listed vehicles that are associated with the vehicle under test information request protocol; and identifying listed vehicles that are associated with the vehicle under test information request protocol;

c) communicating at least one service mode request to the ECU, in the vehicle under test information protocol, excluding each service mode request that is associated with an identified listed vehicle;

d) receiving information from the ECU, in response to the at least one service mode request, and extracting therefrom vehicle characteristic features information identifying characteristic features of the vehicle under test;

e) comparing the extracted characteristic features information to the selective characteristic features information associated with each of the identified listed vehicles to determine if the vehicle under test and any of the identified listed vehicles have common characteristics features;

f) wherein, when the vehicle under test and at least one of the identified listed vehicles have no common characteristic features in common, communicating each of the one or more previously excluded service mode requests to the vehicle under test.

11. The method as recited in claim 10 wherein, when the vehicle under test and at least one of the identified listed vehicles have one or more in common characteristic features, the method further comprises:

g) communicating one or more additional service mode requests to the vehicle, excluding any one or more service mode requests associated with the at least one of the identified listed vehicles.

12. The method as recited in claim 10 wherein the memory unit further includes a listing of one or more service mode request portions associated with a malfunction of any of the listed vehicles, and wherein, when the vehicle under test and at least one of the identified listed vehicles have one or more in common characteristic features, the method further comprises:

h) communicating one or more additional service mode requests to the vehicle, excluding any one or more service mode request portions associated with the at least one of the identified listed vehicles.

13. The method as recited in claim 12 wherein, when the vehicle under test and a plurality of identified listed vehicles have one or more in common characteristic features, the method further comprises:

i) determining which of the plurality of identified listed vehicles has the greatest number of characteristic features in common with the vehicle under test; and j) communicating one or more additional service mode requests to the vehicle under test, excluding any one or more service mode requests associated with the identified listed vehicle having the greatest number of characteristic features in common with the vehicle under test.

14. The method as recited in claim 13 wherein, when the vehicle under test and a plurality of identified listed vehicles have one or more in common characteristic features, the method further comprises:

k) determining which of the plurality of identified listed vehicles has the greatest number of characteristic features in common with the vehicle under test; and l) communicating one or more additional service mode requests to the vehicle under test, excluding any one or more service mode request portions associated with the identified listed vehicle having the greatest number of characteristic features in common with the vehicle under test.

15. The method as recited in claim 10 wherein steps a), c), d) and f) are implemented in the data acquisition device.

16. The method as recited in claim 10 wherein step is implemented in a device located remote from the data acquisition device.

17. The method as recited in claim 10 wherein the memory unit further includes a listing of one or more service mode request portions associated with a malfunction of any of the listed vehicles, and wherein, when the vehicle under test and at least one of the identified listed vehicles have one or more in common characteristic features, the method further comprises:

m) communicating one or more additional service mode requests to the vehicle, excluding any one or more service mode request portions associated with the at least one of the identified listed vehicles.

18. The method as recited in claim 17 wherein, when the vehicle under test and a plurality of identified listed vehicles have one or more in common characteristic features, the method further comprises:

n) determining which of the plurality of identified listed vehicles has the greatest number of characteristic features in common with the vehicle under test; and o) communicating one or more additional service mode requests to the vehicle under test, excluding any one or more service mode requests associated with the identified listed vehicle having the greatest number of characteristic features in common with the vehicle under test.

19. A method of accessing information from an electronic control unit (ECU) of a vehicle under test, in a manner to avoid vehicle malfunctions associated with accessing information in the ECU of diesel engine vehicles, the method comprising:

a) communicating a plurality of linking queries to the ECU, in a plurality of protocols, to identify a vehicle under test information request protocol;

b) storing, in a memory unit, a listing of service mode requests and service mode request portions associated with malfunctions in at least one diesel engine vehicle;

c) communicating at least one service mode request to the ECU, in the vehicle under test information request protocol, excluding each service mode request and service mode request portion associated with a malfunction in the at least one diesel engine vehicle; and d) receiving information from the ECU, in response to the at least one service mode request, and extracting therefrom vehicle characteristic information indicating if the vehicle under test is a diesel engine vehicle, and if an engine of the diesel engine vehicle is currently running;

e) wherein, when the vehicle under test is a diesel engine vehicle, and the engine is currently running, communicating at least one additional service mode request to the vehicle under test, excluding any service mode request and service mode request portion associated with a malfunction in the diesel engine vehicle.

20. The method as recited in claim 19 wherein, when the vehicle under test is not a diesel engine vehicle, or when the engine is not running, the method further comprises:

f) communicating any previously excluded service mode requests and service mode request portions to the vehicle under test.

* * * * *